US011185133B2

(12) United States Patent
Kayahara et al.

(10) Patent No.: US 11,185,133 B2
(45) Date of Patent: Nov. 30, 2021

(54) SLIDER FOR WATERPROOF SLIDE FASTENER AND WATERPROOF SLIDE FASTENER

(71) Applicant: YKK Corporation, Tokyo (JP)

(72) Inventors: Masanori Kayahara, Kurobe (JP); Mineto Terada, Kurobe (JP); Ryo Mikuma, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/079,170

(22) Filed: Oct. 23, 2020

(65) Prior Publication Data

US 2021/0127798 A1 May 6, 2021

(30) Foreign Application Priority Data

Nov. 1, 2019 (JP) ..... JP2019-199494

(51) Int. Cl.
*A44B 19/26* (2006.01)

(52) U.S. Cl.
CPC ..... *A44B 19/265* (2013.01)

(58) Field of Classification Search
CPC ..... A44B 19/265; A44B 19/32; A44B 19/26
See application file for complete search history.

(56) References Cited

U.S. PATENT DOCUMENTS 5,007,144 A * 4/1991 Terada ..... A44B 19/26 24/415
5,297,320 A * 3/1994 Keyaki ..... A44B 19/26 24/430
5,621,954 A * 4/1997 Mizuno ..... A44B 19/26 24/429
D467,523 S * 12/2002 Lin ..... D11/221
6,490,770 B1 * 12/2002 Matsuda ..... A44B 19/26 24/415
6,497,014 B2 * 12/2002 Neugebauer ..... A44B 19/32 24/389
8,104,147 B2 * 1/2012 Peano ..... A44B 19/26 24/388
9,538,817 B2 * 1/2017 Ogura ..... A44B 19/267
10,531,712 B2 * 1/2020 Ogura ..... A44B 19/32
(Continued)

FOREIGN PATENT DOCUMENTS

WO 2018/069971 A1 4/2018

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A slider for a waterproof slide fastener includes an upper blade and a lower blade opposing each other in an up-down direction, and a connecting post connecting the upper blade with the lower blade. Each of opposing surfaces includes a close-contact surface for sandwiching and close-contacting with a first stop in the up-down direction. At least one of the opposing surfaces includes right and left inclined surfaces provided respectively on right and left sides at a front sides of the close-contact surface and inclined in a direction widening a gap between the upper blade and the lower blade as the right and left inclined surfaces go forward. The at least one of the opposing surfaces includes an extended close-contact surface provided between the right and left inclined surfaces and extending forward from the close-contact surface.

5 Claims, 8 Drawing Sheets

(56) References Cited

U.S. PATENT DOCUMENTS

| | | | | |
|---|---|---|---|---|
| 2002/0116798 | A1* | 8/2002 | Okada | A44B 19/386<br>24/433 |
| 2019/0104811 | A1* | 4/2019 | Martinson | A44B 19/42 |
| 2020/0037711 | A1 | 2/2020 | Kayahara et al. | |

* cited by examiner

SLIDER FOR WATERPROOF SLIDE FASTENER AND WATERPROOF SLIDE FASTENER

CROSS-REFERENCE TO RELATED APPLICATIONS

This application is based on Japanese Patent Application (No. 2019-199494) filed on Nov. 1, 2019, the contents of which are incorporated herein by way of reference.

BACKGROUND

The present invention relates to a slider for a waterproof slide fastener capable of preventing liquid, such as water, from permeating therethrough, and to such a waterproof slide fastener.

As waterproof slide fasteners, one disclosed from Patent Literature 1 is known. The waterproof slide fastener includes a pair of fastener stringers arranged side by side in a right and left direction, a slider for opening and closing the pair of fastener stringers, and stops disposed in the vicinity of both limits in a moving range of the slider.

The pair of fastener stringers has a pair of element rows along respective side edge portions thereof, which oppose each other in the right and left direction. Also, the slider includes an upper blade and a lower blade opposing each other in an up-down direction, and a guide post guiding the pair of element rows and connecting the upper blade with the lower blade.

According to the waterproof slide fastener, when the slider is moved to a forward limit position (closing limit position) in the moving range to close the pair of fastener stringers, the upper blade and the lower blade can sandwich and come in close contact with the stop in around the guide post in an up-down direction thereof, thereby preventing water from permeating into a front or back side of the pair of fastener stringers through around the guide post.

Since the upper blade and the lower blade sandwich the stop in around the guide post, The waterproof slider as described above is configured such that as shown in FIG. 5 of Patent Literature 1, the upper blade and the lower blade of the slider extend further forward than a front end of the guide post. Also, in front of the guide post, upper and lower extension portions are configured to sandwich the stop therebetween and thus to come in close contact with the stop. Further, inclined surfaces are formed on respective front edge portions of the upper and lower extension portions so as to widen a distance therebetween in an up-down direction as they go forward. Such inclined surfaces are also formed on a slider that does not require a waterproof property. In this case, the inclined surfaces can facilitate guiding of elements.

Patent Literature 1: International Publication No. WO 2018/069971

SUMMARY

However, in the waterproof slider as above-described, if the slider is moved slightly rearward from the closing limit position and thus rear ends of the inclined surface of the upper blade and lower blade is positioned in the rear of respective close-contact surfaces of the stop, gaps are formed between the inclined surface and the stop, thereby exhibiting no waterproof effect.

The present invention has been made keeping in mind the above problems, and an object thereof is to exhibit a waterproof effect even when a slider is positioned slightly rearward from the closing limit position.

According to the present invention, there is provided a slider for a waterproof slide fastener, wherein the slider is configured to be stopped to move forward by a first stop arranged on a front end of each of right and left fastener stringers being capable of opened and closed, the fastener stringers are closed when the slider is at the front end, and the slider is configured to sandwich and come in close contact with the first stop in an up-down direction of the first stop. The slider includes an upper blade and a lower blade opposing each other in an up-down direction; and a connecting post connecting the upper blade with the lower blade, wherein an element passage is divided by the connecting post into right and left sides to separately extend forward, and is merged at a rear side of the connecting post to extend rearward. Each of opposing surfaces of the upper blade and the lower blade includes a close-contact surface provided around the connecting post and configured to sandwich and come in close contact with the first stop in the up-down direction. At least one of the opposing surfaces includes right and left inclined surfaces provided respectively on right and left sides at a front side of the close-contact surface and inclined in a direction widening a gap between the upper blade and the lower blade as the right and left inclined surfaces go forward. The at least one of the opposing surfaces includes an extended close-contact surface provided between the right and left inclined surfaces and extending forward from the close-contact surface.

The slider of the waterproof slide fastener as described above has the configuration mainly specified from the viewpoint of surfaces thereof. Further, the slider having configurations specified from the viewpoint of three-dimensional structures as well as the surfaces as described above is as follows.

Each of the upper blade and the lower blade includes a main blade portion extending rearward than a front end of the connecting post; and an extension portion extending forward from the main blade portion. Each of the upper and lower extension portions includes in a front portion of the main extension portion a main extension portion inclined in a direction widening a gap between the upper blade and the lower blade as the main extension portion goes forward and being parallel to each other in a rear portion of the main extension portion to equalize the gap, and a protrusion provided in front of the connecting post and protruding from a front portion of at least one of the upper and lower main extension portions in a direction narrowing a gap between the upper blade and the lower blade. Each of the upper and lower main extension portions includes the right and left inclined surfaces; and a front close-contact surface, which is a front portion of the close-contact surface. Each of the protrusion includes the extended close-contact surface. The extended close-contact surface extends forward from the front close-contact surface of the extension portion, from which each of the protrusions protrudes.

In the present invention, it is sufficient if at least one of the upper blade and the lower blade the extended close-contact surface. Also, it is sufficient if at least one of the upper blade and the lower blade the protrusion. However, in order to exhibit an enhanced waterproof effect, the following configuration is preferable.

That is, each of the upper blade and the lower blade includes the protrusion, and each of the opposing surfaces of the upper blade and the lower blade includes the extended close-contact surface.

In addition, it does not matter how right and left surfaces of the protrusion are configured. However, in order to facilitate guiding of the pair of element rows when closing the pair of fastener stringers by moving the slider forward, the following configuration is preferable.

The right and left surfaces of the protrusions are inclined surfaces extending outward in the right and left direction as they go rearward.

A waterproof slide fastener according to the present invention employing the slider as described above is as follows.

The waterproof slide fastener includes a pair of fastener stringers including a pair of tapes extending in a front and rear direction and arranged adjacent to each other in a right and left direction and a pair of element rows fixed along opposing side edge portions of the pair of tapes; the slider as described above; and a first stop for coming in contact with the slider and stopping moving of the slider, being configured to connect the pair of tapes with each other in front of the pair of element rows.

DETAILED DESCRIPTION OF EXEMPLIFIED EMBODIMENTS

Figure 10:
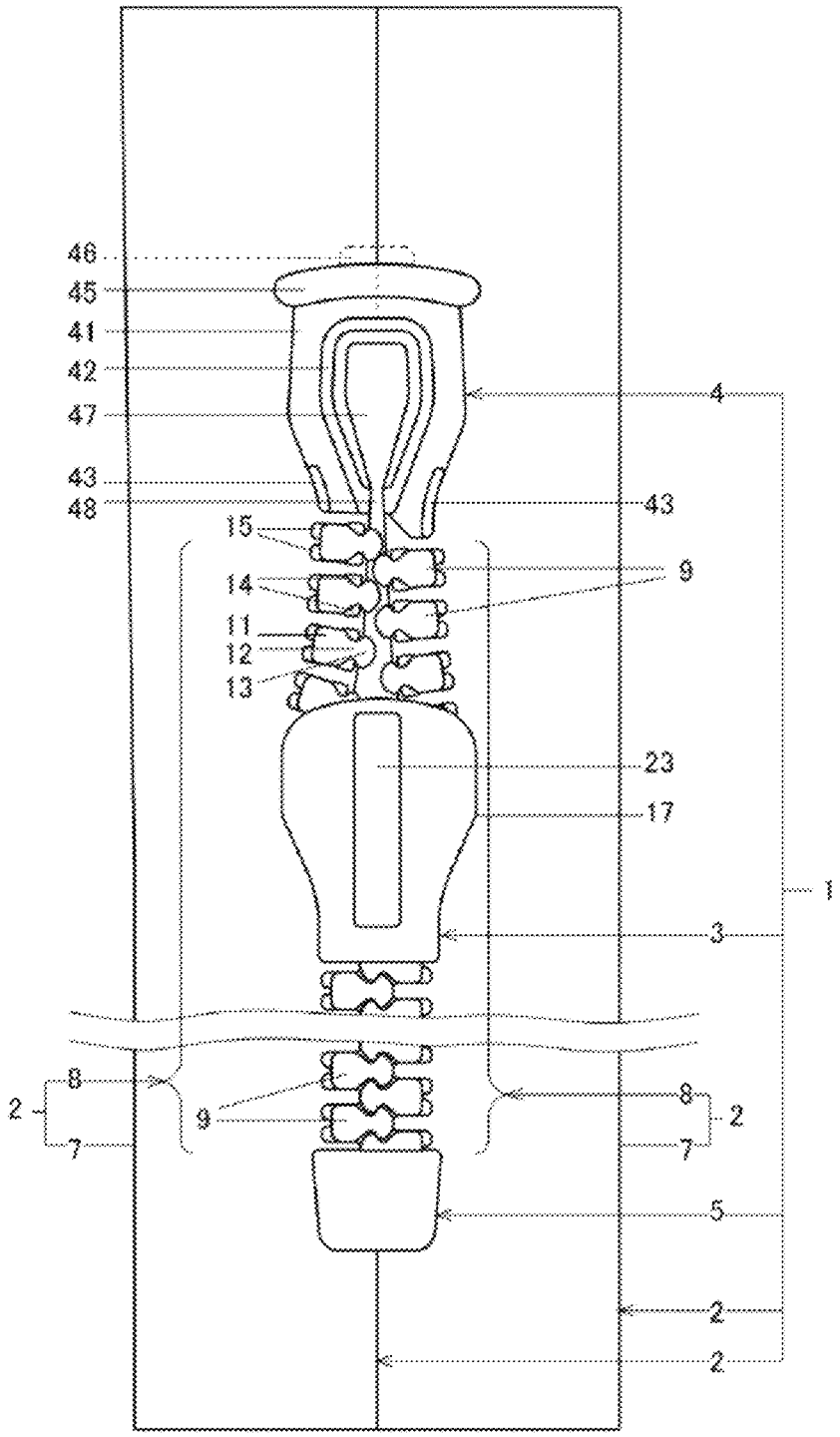
FIG. 10 is a plan view showing the waterproof slide fastener according to the first embodiment of the present invention.

As shown in FIG. 10, a waterproof slide fastener 1 according to a first embodiment of the present invention includes a pair of right and left fastener stringers 2, 2 adjacent to and side by side with each other; a slider 3 movable forward and rearward to open and close the pair of fastener stringers 2, 2; and a first stop 4 and a second stop 5 for stopping moving of the slider 3 on a respective one of front and rear limits of a moving range of the slider 3.

Directions are defined as follows. A "front and rear direction" is a direction, along which the pair of fastener stringers 2, 2 are opened and closed, and corresponds to an up-down direction in FIG. 10. The "front direction" is a direction, along which the pair of fastener stringers 2, 2 are closed, and corresponds to the up direction in FIG. 10. The "rear direction" is a direction, along which the pair of fastener stringers 2, 2 are opened, and corresponds to the down direction in FIG. 10.

A "right and left direction" is a right and left direction in FIG. 10. The "left direction" corresponds to the left direction in FIG. 10. The "right direction" corresponds to the right direction in FIG. 10.

An "up-down direction" is a thickness direction of the fastener stringers 2 and corresponds to a direction perpendicular to the paper surface of FIG. 10. The "up direction" is a direction which extends toward a near side with respect to the paper surface of FIG. 10. The "down direction" is a direction which extends toward a far side with respect to the paper surface of FIG. 10.

The pair of fastener stringers 2, 2 includes a pair of tapes 7, 7 extending in the front and rear direction and also arranged adjacent to and side by side with each other in the right and left direction; and a pair of element rows 8, 8 fixed along opposing side edge portions of the pair of tapes 7, 7.

Each of the tapes 7 has the shape of a band elongated in the front and rear direction, and a thickness direction thereof is referred to as the up-down direction. Although not shown in detail, the tape 7 includes a tape main body made of a woven or knitted fabric, and a coating layer covering at least one surface, in the thickness direction, of the tape main body. For example, the coating layer may include a layer made of a thermoplastic elastomer, a layer, in which a water repelling layer made of a water repellent is formed on the thermoplastic elastomer layer, or a water repelling layer made of a water repellent formed instead of the thermoplastic elastomer layer. Therefore, the tape 7 has a waterproof property in the thickness direction.

Each of the element rows 8 is formed by a plurality of elements 9 fixed along a side edge portion of the respective tape 7, which faces the opposing tape 7, while being spaced from each other in the front and rear direction. More specifically, the elements 9 are formed by injection-molding on the tape 7. In a state where the pair of fastener stringers 2, 2 are closed, elements 9 of one of the pair of element rows 8, 8 are engaged with elements 9 of the other. In a state where the pair of fastener stringers 2, 2 are opened, elements 9 of one of the pair of element rows 8, 8 are disengaged from elements 9 of the other in the right and left direction.

Each element 9 includes a body portion 11 fixed to the respective tape 7 and extending in the right and left direction; a neck portion 12 protruding from a middle portion, in the front and rear direction, of the body portion 11 toward the opposing tape 7; a head portion 13 protruding from the neck portion 12 toward the opposing tape 7 and also bulging out in the front and rear direction; a pair of shoulder portions 14, 14 protruding from respective front and rear sides of the neck portion 12; and fin portion 15 protruding from the body portion 11 in a direction opposite to the opposing tape 7. In addition, two fin portions 15 are provided to be spaced in the front and rear direction. Also, the pair of fin portions 15, 15 and the pair of shoulder portions 14, 14 are formed in a stepped shape to be thinner than the body portion 11.

Further, the pair of fin portions 15, 15, the body portion 11, the pair of shoulder portions 14, 14 and the neck portion 12 are configured such that the opposing side edge portions of the tapes 7 are buried in middle portions thereof in the thickness direction. Therefore, the elements 9 are fixed on the tape 7 in such a manner to clamp the tape 7 from the top and bottom thereof.

The head portion 13 has a groove (not shown) in a distal end surface thereof, which faces the opposing tape 7. The groove is opened toward the opposing tape 7 and also in the front and rear direction. In a state where the elements 9 are engaged with each other, a pair of shoulder portions 14, 14 of the opposing tape 7 are fitted in the groove. Further, it is the slider 3 which causes the elements 9 to be engaged with and disengaged from each other.

As shown in FIGS. 1 to 3C, the slider 3 is configured to be moved along the pair of element rows 8, 8. The slider 3 includes a slider body 17 configured to be engaged with the pair of element rows 8, 8 and also to be movable in the front and rear direction; and a pull (not shown) connected to the slider body 17.

The slider body 17 includes an upper blade 18 and a lower blade 19 arranged to be spaced from and oppose each other in the up-down direction; a connecting post 21 connecting the upper blade 18 with the lower blade 19; an upper and lower right and left flanges 22, 22, 22, 22 protruding from right and left edge portions of both the upper blade 18 and the lower blade 19 in a direction narrowing a gap therebetween; and a pull attachment portion 23 protruding from an upper surface of the upper blade 18.

The pull attachment portion 23 and the upper blade 18 cooperate with each other to define a through hole (not shown) allowing the pull to be attached.

The connecting post 21 extends in the up-down direction and connects the upper blade 18 with the lower blade 19 at middle portions, in the right and left direction, of front portions thereof. The connecting post 21 is positioned between the pair of element rows 8, 8.

Figure 8:
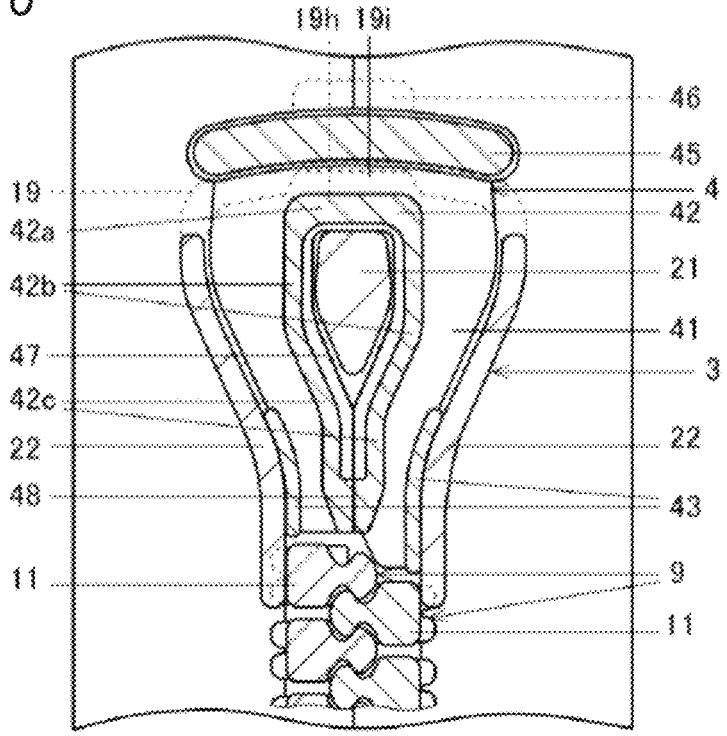
FIG. 8 is a sectional view taken along a line VIII-VIII in FIG. 6.

As shown in FIG. 8, the flanges 22 are formed to be in close contact with the body portions 11 of the right and left elements 9 located at the most front side when the slider 3 is positioned at a forward limit position (closing limit position).

Figure 1:
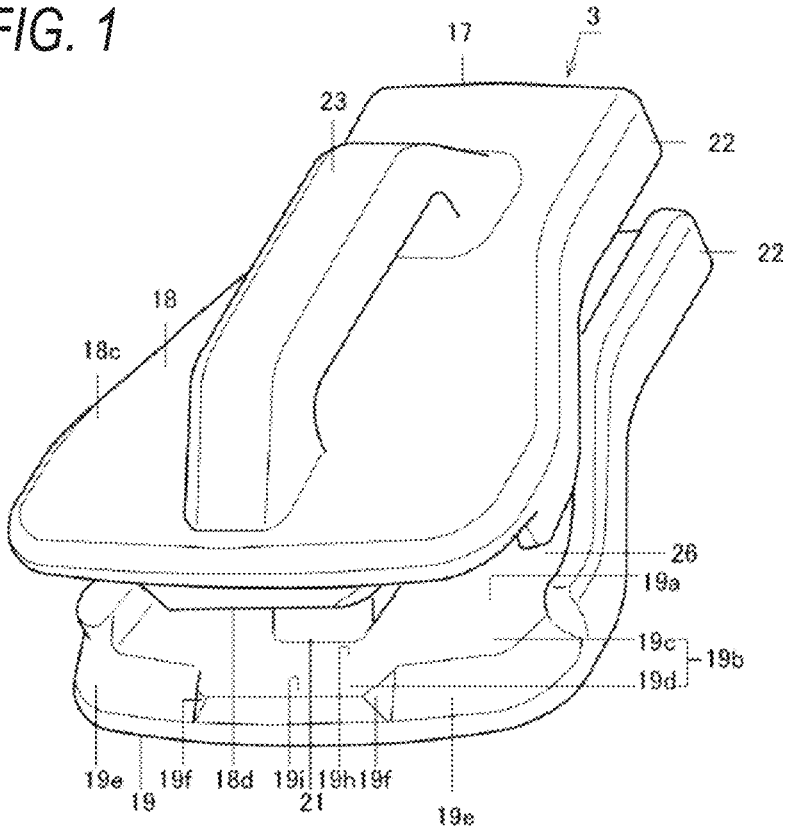
FIG. 1 is a perspective view showing a slider to be used in a waterproof slide fastener according to a first embodiment of the present invention.
Figure 2:
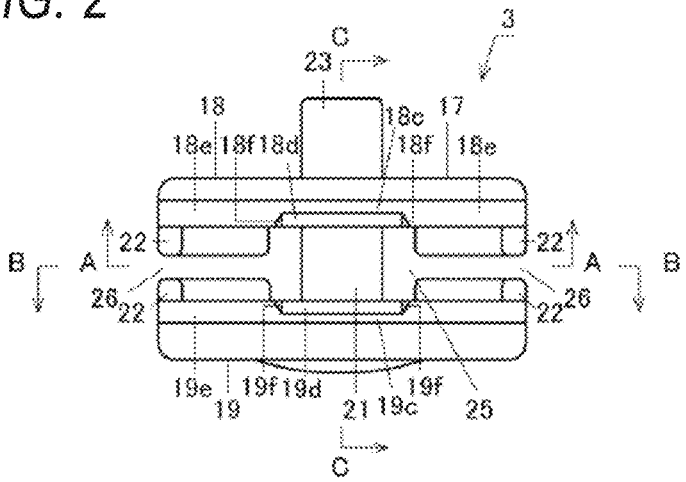
FIG. 2 is a view showing the slider as viewed from the front.

As shown in FIGS. 1 and 2, in addition to tangible components, such as the upper blade 18, the lower blade 19, the connecting post 21, the flanges 22 and the pull attachment portion 23, the slider body 17 includes an element passage 25 allowing the pair of element rows 8, 8 to pass therethrough, and a pair of tape grooves 26, 26 allowing the pair of the tapes 7, 7 to pass respectively therethrough, as intangible components (space portions) defined by the tangible components.

The element passage 25 has a so-called Y-shape, in which the element passage 25 is divided by the connecting post 21 into right and left sides to separately extend forward and is merged at a rear side of the connecting post 21 to extend rearward. The element passage 25 is delimited by the upper blade 18 and the lower blade 19 in the up-down direction, delimited by the upper and lower right and left flanges 22 in the right and left direction and also delimited by the connecting post 21 at a front middle portion thereof.

Each of the tape grooves 26 is delimited by the opposing upper and lower flanges 22, 22 in the up-down direction and is communicated with the element passage 25 and the external space of the slider body 17 in the right and left direction.

The upper blade 18 and the lower blade 19 have a symmetrical configuration in the up-down direction. Hereinafter, the upper blade 18 will be described in detail and the lower blade 19 will be briefly described. As shown in FIGS. 2 and 3, the upper blade 18 includes a main blade portion 18*a* extending further rearward than a front end of the connecting post 21, and an extension portion 18*b* extending forward from the main blade portion 18*a*. Similarly, the lower blade 19 includes a main blade portion 19*a* and an extension portion 19*b*.

A lower surface of the main blade portion 18*a* of the upper blade 18 (surface thereof facing the lower blade 19) is a flat surface perpendicular to the up-down direction. An upper surface of the main blade portion 19*a* of the lower blade 19 (surface thereof facing the upper blade 18) is also a flat surface perpendicular to the up-down direction.

The extension portion 18*b* of the upper blade 18 includes a main extension portion 18*c* extending forward from a front end of the main blade portion 18*a*, and a protrusion 18*d* located in front of the connecting post 21 and protruding in the down direction from a front portion of the main extension portion 18*c*. Similarly, the extension portion 19*b* of the lower blade 19 includes a main extension portion 19*c* and a protrusion 19*d* protruding in the up direction from a front portion of the main extension portion 19*c*. The main extension portions 18*c*, 19*c*, which oppose each other in the up-down direction, are configured such that front portions thereof (from which the protrusions 18*d*, 19*d* protrude) are inclined in a direction widening a gap therebetween as they go forward and rear portions thereof are parallel to each other to have a constant gap therebetween.

A rear portion of a lower surface of the main extension portion 18*c* of the upper blade 18 is a flat surface continuous to the lower surface of the main blade portion 18*a* of the upper blade 18. On the other hand, a front portion of the lower surface of the main extension portion 18*c* of the upper blade 18 (a front edge portion of the lower surface of the upper blade 18) is an inclined surface 18*e* inclined in an up direction as it goes forward (i.e., an inclined surface inclined in the up direction as it goes forward based on the front and rear direction). The inclined surface 18*e* not only extends in the right and left direction, but also extends rearward from right and left ends of the upper blade 18 toward the right and left flanges 22, 22. In other words, in the example of FIG. 3A to 3C, the right and left flanges 22, 22 are configured to extend rearward from the rear of the front end of the upper blade 18. Therefore, right and left ends of the inclined surface 18*e* are configured to extend in the front and rear direction from the front end of the upper blade 18 to a front end of the respective flanges 22. Further, a middle portion, in the right and left direction, of the inclined surface 18*e* is positioned in front of the connecting post 21, and the protrusion 18*d* of the upper blade 18 protrudes from the middle portion. As a result, the lower surface of the main extension portion 18*c* of the upper blade 18 is provided with inclined surfaces 18*e*, 18*e* on right and left sides of the protrusion 18*d*. On the other hand, in the example of FIG. 3A to 3C, the protrusion 18*d* is formed over a range from the rear of the front end of the main extension portion 18*c* to the front end of the main blade portion 18*a*. That is, in the example of FIG. 3A to 3C, a distance D is formed between a front end of the protrusion 18*d* and the front end of the upper blade 18, and a front end position of the protrusion 18*d* of the upper blade 18 is a rear end position of the distance D (i.e., at the rear of the front end of the upper blade 18).

Figure 3A:
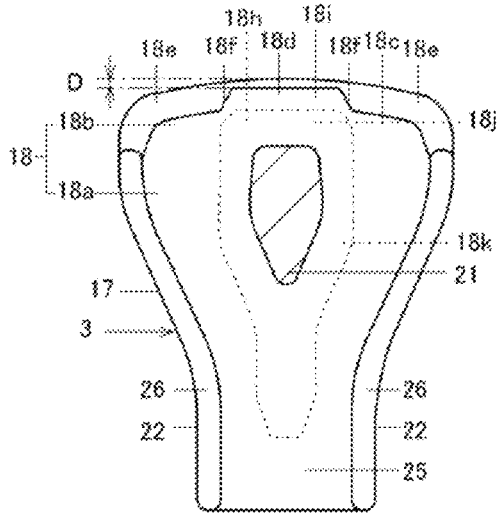
FIG. 3A is a sectional view taken along a line A-A in FIG. 2.
Figure 3B:
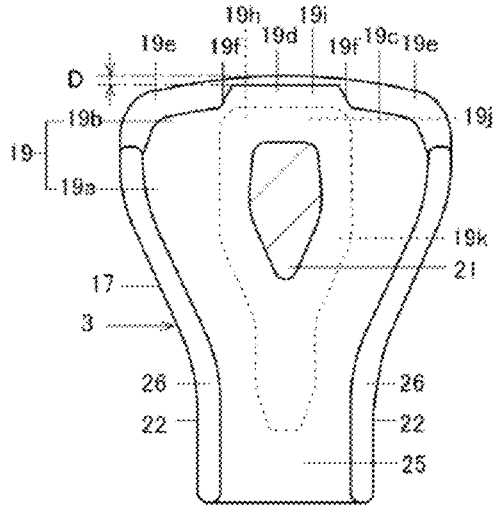
FIG. 3B is a sectional view taken along a line B-B in FIG. 2.
Figure 3C:
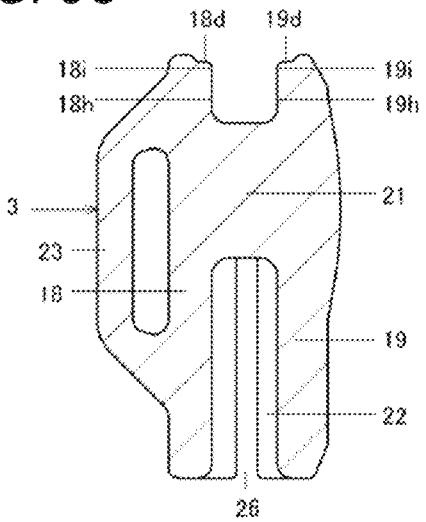
FIG. 3C is a sectional view taken along a line C-C in FIG. 2.

Similarly, a rear portion of the upper surface of the main extension portion 19*c* of the lower blade 19 is a flat surface continuous to the upper surface of the main blade portion 19*a* of the upper blade 19. On the other hand, a front portion of the upper surface of the main extension portion 19*c* of the lower blade 19 (a front edge portion of the upper surface of the lower blade 19) is similarly an inclined surface 19*e* inclined in the down direction as it goes forward (i.e., an inclined surface inclined in the down direction as it goes forward based on the front and rear direction). Similarly, the protrusion 19*d* of the lower blade 19 protrudes from a middle portion, in the right and left direction, of the inclined surface 19*e*. Also, the upper surface of the main extension portion 19*c* of the lower blade 19 is provided with inclined surfaces 19*e*, 19*e* on right and left sides of the protrusion 19*d*. In the example of FIG. 3A to 3C, the protrusion 19*d* is similarly formed over a range from the rear of the front end of the main extension portion 19*c* to the front end of the main blade portion 19*a*. That is, in the example of FIG. 3A to 3C, a front end position of the protrusion 19*d* of the lower blade 19 is a rear end position of a distance D (i.e., at the rear of the front end of the lower blade 19).

Further, the right and left inclined surfaces 18*e*, 18*e*, 19*e*, 19*e* of the upper blade 18 and the lower blade 19 are inclined in a direction widening a gap therebetween in the up-down direction as they go forward, thereby facilitating guiding of the elements 9 into the element passage 25 of the slider 3 when the slider 3 is moved forward. On the other hand, the details of the opposing surfaces of the upper blade 18 and the lower blade 19 will be described together with a configuration of the first stop 4.

A left surface 18*f* of the protrusion 18*d* of the upper blade 18 is an inclined surface extending in the left direction as it goes rearward. Similarly, a right surface 18*f* of the protrusion 18*d* of the upper blade 18 is an inclined surface extending in the right direction as it goes rearward. That is, the right and left surfaces 18*f*, 18*f* of the upper blade 18 are inclined surfaces inclined outside in the right and left direction as they go rearward. Similarly, right and left surfaces 19*f*, 19*f* of the protrusion 19*d* of the lower blade 19 are inclined surfaces inclined outside in the right and left direction as they go rearward.

It is the first stop 4 which stops moving of the slider 3 forward as described above and thus defines a forward limit position of a moving range of the slider 3.

As shown in FIGS. 8 and 10, the first stop 4 is fixed on a closed end of the pair of fastener stringers 2, 2, i.e., on a front end thereof, to connect front ends of the pair of tapes 7, 7 with each other. More specifically, the first stop 4 is fixed on the pair of tapes 7, 7 in front of the element rows 8 to be spaced from the element rows 8.

The first stop 4 is a resin having rubber elasticity, such as a thermoplastic elastomer, and is elastically deformable by rubber elasticity. The first stop 4 includes an annular receiving body 41 configured to be opened and closed and also to receive the connecting post 21 of the slider 3 to allow the connecting post 21 to enter and exit; a pair of close-contact walls 42, 42 configured to be raised from both surfaces (upper and lower surfaces), in a thickness direction, of the receiving body 41 and also to come in close contact with the opposing surfaces of the upper blade 18 and the lower blade 19 over the entire annular circumference of the receiving body 41; and upper and lower right and left sub-close-contact walls 43 as right and left side edge portions of a rear portion of the receiving portion 41 configured to be raised from both surfaces (upper and lower surfaces), in the thickness direction, of the receiving body 41 and also to come in close contact with right and left inner surfaces of the upper and lower right and left flanges 22, 22, 22, 22. In addition, the first stop 4 includes a pair of raised portions 45, 45 as a front portion of the receiving body 41 configured to be raised from both surfaces (upper and lower surfaces), in the thickness direction, of the receiving body 41 in front of the pair of close-contact walls 42, 42; and a bulged portion 46 configured to be bulged forward from a portion of a front surface of the receiving body 41, which is positioned on the side of one surface (lower surface), in the thickness direction, of the receiving body 41.

The receiving body 41 is configured such that the opposing side edge portions of the pair of tapes 7, 7 are buried in a middle portion thereof in the thickness direction. More specifically, with respect to the opposing side edge portions of the pair of tapes 7, 7, the receiving body 41 is configured to cover both upper and lower surfaces of the pair of tapes 7, 7 and also to cover opposing surfaces of the pair of tapes 7, 7. Also, the receiving body 41 has an annular shape surrounding around the connecting post 21. Further, a post receiving hole 47 for receiving the connecting post 21 is formed inside the receiving body 41 to extend therethrough in the up-down direction. Further, on a rear portion of the receiving body 41, an entrance portion 48 is formed to be opened and closed, thereby allowing the connecting post 21 to enter and exit the post receiving hole 47. The receiving body 41 can be opened and closed by rubber elasticity of the first stop 4, in such a manner that when the entrance portion 48 is opened, a passage leading to the post receiving hole 47 is formed and when the entrance portion 48 is closed, the entrance portion 48 is in close contact in the right and left direction.

In addition, the pair of tapes 7, 7 are integrally rested on an upper surface of the bulged portion 46.

The pair of close-contact walls 42 and 42 extend over the entire circumference of the container 41 in a circumferential direction thereof and are formed to protrude from portions of both the upper and lower surfaces of the receiving body 41, which correspond to middle portions thereof in an inward and outward direction (width direction) with respect to the annular shape. Also, as shown in FIG. 8, each of the close-contact walls 42 includes a transversal wall portion 42*a* extending in the right and left direction in front of the connecting post 21; right and left longitudinal walls 42*b*, 42*b* linearly extending rearward from right and left ends of the transversal wall portion 42*a*; and right and left approaching wall portions 42*c*, 42*c* extending rearward from rear ends of the right and left longitudinal walls 42*b*, 42*b* so as to approach each other in the right and left direction. The upper blade 18 and the lower blade 19 sandwich the pair of close-contact walls 42 and 42 in the up-down direction thereof and thus come in close contact with the pair of close-contact walls 42, 42.

As shown in FIG. 3A, the lower surface of the upper blade 18 (surface thereof opposing the lower blade 19) includes a close-contact surface 18*h* configured to come in close contact with the top surface of the first stop 4 located around the connecting post 21 when the slider 3 is positioned at the forward limit position (closing limit position) and right and left inclined surfaces 18*e*, 18*e* located on the right and left sides at a front side of the close-contact surface 18*h*; and an extended close-contact surface 18*i* located between the right and left inclined surfaces 18*e*, 18*e* and extending forward from the close-contact surface 18*h*. In addition, the close-contact surface 18*h* and the extended close-contact surface 18*i* are the flat surface of the upper blade 18 as described above (i.e., the flat surface perpendicular to the up-down direction). Similarly, as shown in FIG. 3B, the upper surface of the lower blade 19 (surface thereof opposing the upper blade 18) includes a close-contact surface 19*h*, right and left inclined surfaces 19*e*, 19*e* and an extended close-contact surface 19*i*. Further, the close-contact surface 19*h* and the extended close-contact surface 19*i* are the flat surface of the lower blade 19 as described above (i.e., the flat surface perpendicular to the up-down direction).

The close-contact surface 18*h* of the upper blade 18 has an annular shape surrounding around the connecting post 21 and is represented by a range surrounded by a dotted line in FIG. 3A. Assuming that the close-contact surface 18*h* is constructed by front and rear portions thereof relative to the front end of the connecting post 21 as a reference position in the front and rear direction, the close-contact surface 18*h* is constructed by a front close-contact surface 18*j*, which is the front portion of the close-contact surface 18*h*, and a rear close-contact surface 18*k*, which is the rear portion of the close-contact surface 18*h*.

The front close-contact surface 18*j* of the upper blade 18 is configured to come in close contact with a portion of the upper close-contact wall 42 of the first stop 4, which is located around the connecting post 21 and in front of the front end of the connecting post 21. On the other hand, the rear close-contact surface 18*k* of the upper blade 18 is configured to come in close contact with a portion of the upper close-contact wall 42 of the first stop 4, which is located around the connecting post 21 and in the rear of the front end of the connecting post 21.

Similarly, the close-contact surface 19*h* of the lower blade 19 has an annular shape and is represented by a range surrounded by a dotted line in FIG. 3B. Similarly, the close-contact surface 19*h* is constructed by a front close-contact surface 19*j* and a rear close-contact surface 19*k*.

The upper and lower front close-contact surfaces 18*j*, 19*j* are configured to come in close contact with portions of the pair of close-contact walls 42 of the first stop 4, which are located around the connecting post 21 and in front of the front end of the connecting post 21, thereby sandwiching the pair of close-contact walls 42, 42 in the up-down direction thereof. On the other hand, the upper and lower rear close-contact surfaces 18*k*, 19*k* are configured to come in close contact with portions of the pair of close-contact walls 42 of the first stop 4, which are located around the connecting post 21 and in the rear of the front end of the connecting post 21, thereby sandwiching the pair of close-contact walls 42, 42 in the up-down direction thereof.

Figure 9:
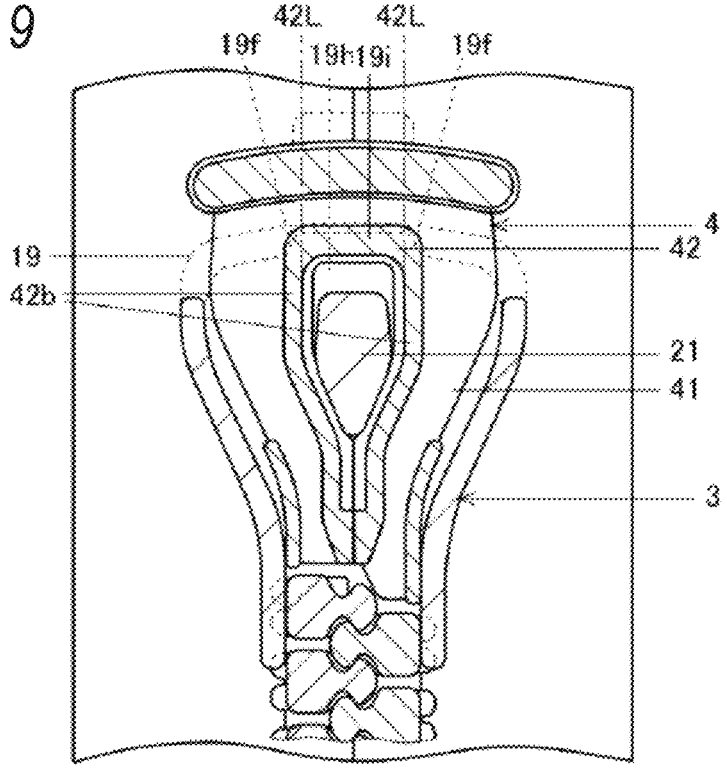
FIG. 9 is a sectional view taken along a line IX-IX in FIG. 7.

The extended close-contact surface 18*i* of the upper blade 18 is a lower surface of the protrusion 18*d* of the upper blade 18 and extends forward from the front close-contact surface 18*j* of the extension portion 18*b* of the upper blade 18 (i.e., the front close-contact surface 18*j* of the upper blade 18). Similarly, the extended close-contact surface 19*i* of the lower blade 19 is an upper surface of the protrusion 19*d* of the lower blade 19 and extends forward from the front close-contact surface 19*j* of the extension portion 19*b* of the lower blade 19 (i.e., the front close-contact surface 19*j* of the lower blade 19). In addition, as shown in FIG. 9, right and left sides of the extended close-contact surface 19*i* of the lower blade 19 coincide with the right and left surfaces 19*f*, 19*f* of the protrusion 19*d* of the lower blade 19 and have a shape extending outside in the right and left direction as they go rearward. Also, both right and left ends of a front side of the extended close-contact surface 19*i* of the lower blade 19 are located more outside in the right and left direction than an extension line 42L of an inner side of each of the right and left longitudinal wall portions 42*b* of the close-contact wall 42. When the slider 3 including the upper and lower extended close-contact surfaces 18*i*, 19*i* is moved rearward, the slider 3 collides against the second stop 5.

As shown in FIG. 10, the first stop 5 is fixed on the rear of the pair of element rows 8, 8 to connect the pair of tapes 7, 7 with each other. Also, the second stop 5 is configured to protrude from both upper and lower surfaces of the pair of tapes 7, 7. Further, the second stop 5 has a thickness in the up-down direction thicker than those of the elements 9, thereby allowing a rear surface of the slider 3 to collide thereagainst. On the other hand, the second stop 5 is also made of resin and is formed by injection molding.

Figure 4:
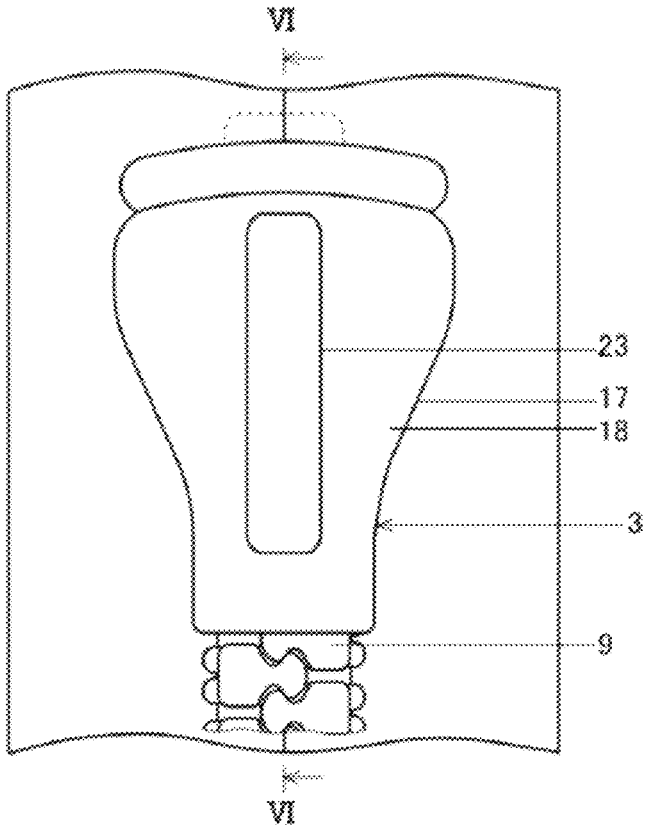
FIG. 4 is a plan view showing a state where the slider is positioned at a closing limit position.
Figure 5:
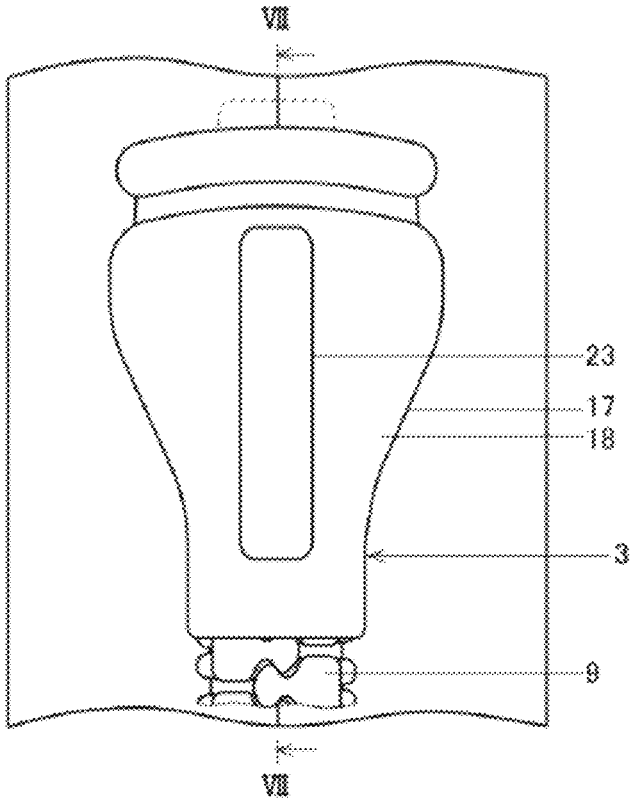
FIG. 5 is a plan view showing a state where the slider is moved slightly rearward from the closing limit position.
Figure 6:
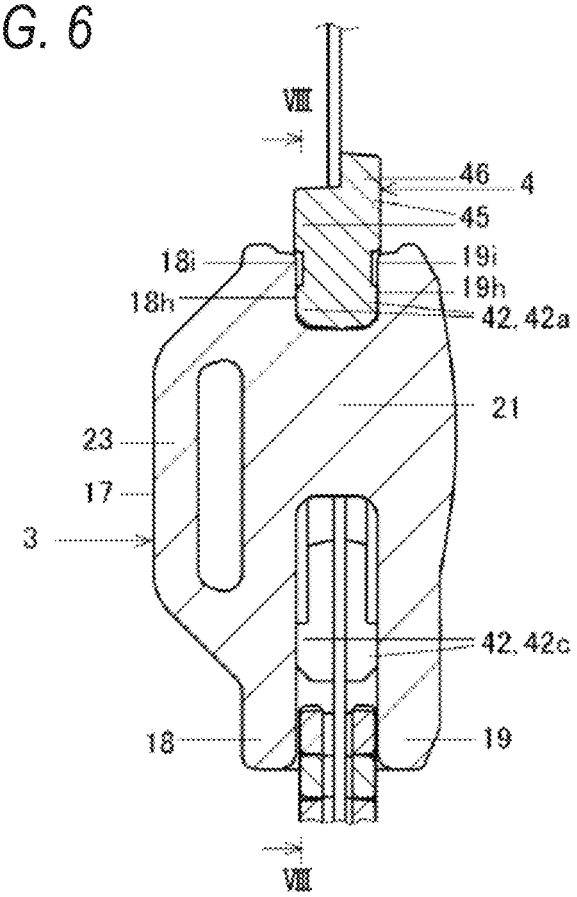
FIG. 6 is a sectional view taken along a line VI-VI in FIG. 4.
Figure 7:
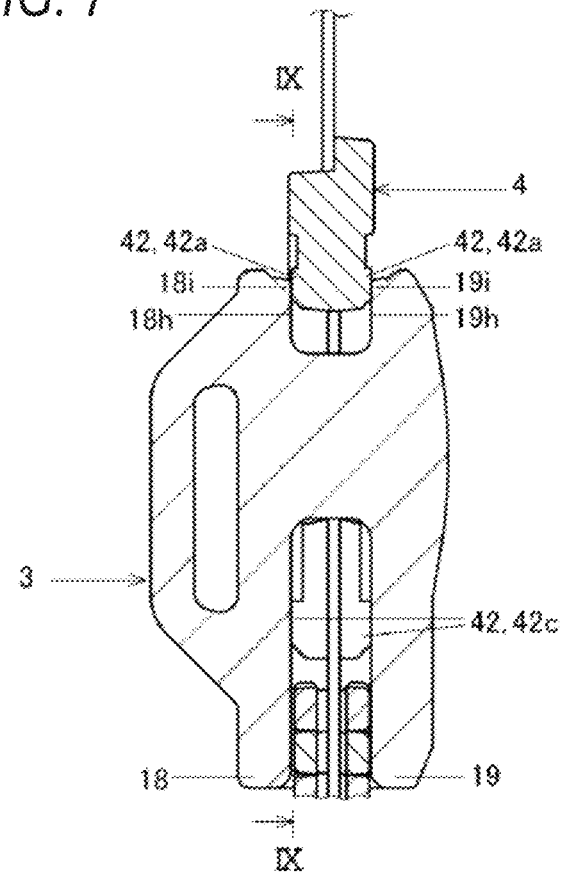
FIG. 7 is a sectional view taken along a line VII-VII in FIG. 5.

According to the waterproof slide fastener 1 and the slider 3 of the first embodiment of the present invention, the slider 3 has the close-contact surfaces 18*h*, 19*h*. Therefore, as shown in FIGS. 4, 6 and 8, when the slider 3 is positioned at the closing limit position, the close-contact surface 18*h* of the upper blade 18 and the close-contact surface 19*h* of the lower blade 19 in the vicinity of the connecting post 21 are respectively in close contact with the upper and lower close-contact walls 42, 42 of the first stop 4, thereby exhibiting a waterproof effect. Further, the slider 3 has the extended close-contact surfaces 18*i*, 19*i*. As shown in FIGS. 5, 7 and 9, even when the slider 3 is positioned slightly rearward from the closing limit position, the close-contact surfaces 18*h*, 19*h* and the extended close-contact surfaces 18*i*, 19*i* of the upper blade 18 and the lower blade 19 in the vicinity of the connecting post 21 can be respectively in close contact with the upper and lower close-contact walls 42, 42 of the first stop 4, thereby exhibiting a waterproof effect. In addition, the slider 3 has the upper and lower extended close-contact surfaces 18*i*, 19*i*. Therefore, it is possible to exhibit an enhanced waterproof effect, as compared with a case where only one extended close-contact surface is provided.

Also, according to the waterproof slide fastener 1 and the slider 3 of the first embodiment of the present invention, the right and left surfaces 18*f*, 18*f*, 19*f*, 19*f* of the protrusions 18*d*, 19*d* of the slider 3 are inclined surfaces extending outside in the right and left direction as they go rearward. Therefore, if the pair of fastener stringers 2, 2 are closed by moving the slider 3 forward under a situation where the slider 3 is positioned at a location other than both front and rear ends of the pair of element rows 8, 8 as shown in FIG. 10 (on a middle portion of the entire length thereof), it is possible to facilitate guiding of the pair of element rows 8, 8 in such a manner that the pair of the element rows 8, 8 are separated into right and left sides with respect to the connecting post 21 as they go from the front end side of the slider 3, which is close to the first stop 4, toward the rear side of the slider 3. Further, the slider 3 has the upper and lower protrusions 18*d*, 19*d*, and the right and left surfaces 18*f*, 18*f*, 19*f*, 19*f* of the upper and lower protrusions 18*d*, 19*d* are inclined surfaces extending outside in the right and left direction as they go rearward. Therefore, it is possible to exhibit an enhanced waterproof effect, as compared with a case where only one of the upper and lower protrusions is provided.

The present invention is not limited to the foregoing embodiments, but may be appropriately modified without departing from the spirit and scope thereof.

For example, although, in the foregoing embodiments, the front end of the protrusion 18*d* of the upper blade 18 is located at the rear of the front end of the upper blade 18, the present invention is not limited thereto. The front end of the protrusion 18*d* may be located to coincide with the front end of the upper blade 18. The protrusion 19*d* of the lower blade 19 may also be configured in a similar manner.

Further, although in the foregoing embodiments, the slider 3 is configured to have the upper and lower protrusions 18*d*, 19*d*, the present invention is not limited thereto. Only one of the upper and lower protrusions 18*d*, 19*d* may be provided.

What is claimed is:

1. A slider for a waterproof slide fastener, wherein the slider is configured to be stopped to move forward by a first stop arranged on a front end of each of right and left fastener stringers being capable of opened and closed, the fastener stringers are closed when the slider is at the front end, and the slider is configured to sandwich and come in close contact with the first stop in an up-down direction of the slider, the slider comprising:

an upper blade and a lower blade opposing each other in the up-down direction; and a connecting post connecting the upper blade with the lower blade, wherein an element passage is divided by the connecting post into right and left sides to separately extend forward, and is merged at a rear side of the connecting post to extend rearward, each of opposing surfaces of the upper blade and the lower blade includes a close-contact surface provided around the connecting post and configured to sandwich and come in close contact with the first stop in the up-down direction, and at least one of the opposing surfaces includes right and left inclined surfaces provided respectively on right and left sides at a front side of the close-contact surface and inclined in a direction widening a gap between the upper blade and the lower blade as the right and left inclined surfaces go forward, and the at least one of the opposing surfaces includes a protrusion which includes an extended close-contact surface being provided between the right and left inclined surfaces and extending forward from the close-contact surface.

2. The slider for the waterproof slide fastener according to claim 1, wherein each of the upper blade and the lower blade includes a main blade portion extending rearward than a front end of the connecting post and an extension portion extending forward from the main blade portion, each of the extension portions includes a main extension portion inclined in a front portion of the main extension portion in the direction widening the gap between the upper blade and the lower blade as the main extension portion goes forward and being parallel to each other in a rear portion of the main extension portion to equalize the gap, at least one of the extension portions includes the protrusion provided in front of the connecting post and protruding from the front portion of the main extension portion in a direction narrowing the gap between the upper blade and the lower blade, each of the main extension portions includes the right and left inclined surfaces and a front close-contact surface, which is a front portion of the close-contact surface, the protrusion includes the extended close-contact surface, and the extended close-contact surface extends forward from the front close-contact surface of the extension portion from which the protrusion protrudes.

3. The slider for the waterproof slide fastener according to claim 2, wherein each of the upper blade and the lower blade includes the protrusion, and each of the opposing surfaces of the upper blade and the lower blade includes the extended close-contact surface.

4. The slider for the waterproof slide fastener according to claim 2, wherein right and left surfaces of the protrusion are inclined surfaces extending outside in a right and left direction of slider as the right and left surfaces go rearward.

5. A waterproof slide fastener, comprising:

a pair of fastener stringers including a pair of tapes extending in a front and rear direction and arranged adjacent to each other in a right and left direction and a pair of element rows fixed along opposing side edge portions of the pair of tapes;

the slider according to claim 1; and a first stop configured to coming in close contact with the slider and stopping moving of the slider, and connecting the pair of tapes with each other in front of the pair of element rows.

* * * * *